US005658201A

United States Patent [19]

Kleimeyer et al.

[11] Patent Number: 5,658,201

[45] Date of Patent: Aug. 19, 1997

[54] SWINGING BOOM AMUSEMENT RIDE

[75] Inventors: Mark A. Kleimeyer, Panama City Beach, Fla.; Stat Cochron, Wisconsin Dells, Wis.

[73] Assignee: AirSurfer, Inc., Atlanta, Ga.

[21] Appl. No.: 556,612

[22] Filed: Nov. 13, 1995

[51] Int. Cl.[6] ..... A63G 31/08

[52] U.S. Cl. ..... 472/44; 472/45; 472/27

[58] Field of Search ..... 472/2, 3, 27, 44, 472/49, 50, 130, 131, 133, 135

[56] References Cited

U.S. PATENT DOCUMENTS

| | | | |
|---|---|---|---|
| 1,229,519 | 6/1917 | Rach . | |
| 1,731,532 | 10/1929 | Hoppes . | |
| 1,918,559 | 7/1933 | Pruessner . | |
| 1,987,004 | 1/1935 | Eyerly | 472/44 |
| 2,172,451 | 9/1939 | Powers . | |
| 2,311,171 | 2/1943 | Hawthorne . | |
| 2,779,596 | 1/1957 | Ridgway . | |
| 3,298,685 | 1/1967 | Williams . | |
| 3,476,385 | 11/1969 | Foy . | |
| 3,701,528 | 10/1972 | Ryan . | |
| 3,840,225 | 10/1974 | Fonche | 472/3 |
| 3,885,503 | 5/1975 | Barber . | |
| 3,885,788 | 5/1975 | Harris . | |
| 4,410,173 | 10/1983 | Böhme | 472/44 |
| 4,978,120 | 12/1990 | Greenwood . | |
| 5,094,448 | 3/1992 | Hackett . | |
| 5,203,744 | 4/1993 | Checketts . | |
| 5,267,906 | 12/1993 | Kitchen et al. . | |
| 5,417,615 | 5/1995 | Beard . | |
| 5,421,783 | 6/1995 | Kockelman et al. . | |

FOREIGN PATENT DOCUMENTS

| | | | |
|---|---|---|---|
| 2489704 | 2/1982 | France | 472/44 |
| 323435 | 3/1984 | Germany | 472/44 |
| 33 38048 A1 | 5/1985 | Germany . | |

OTHER PUBLICATIONS

Declaration of Stat Cochran dated Mar. 8, 1996.

Letter from the Patent Law Offices of Rick Martin, P.C. conveying prior consisting of photocopies of amusement rides, dated Mar. 27, 1997.

*Primary Examiner*—Kien T. Nguyen

*Attorney, Agent, or Firm*—Jones & Askew

[57] ABSTRACT

An amusement ride 10 including a tower 12 that pivotably supports an elongated boom 16 that includes an extended end 20 and a pivot 18. A passenger carriage 28 is pivotably attached to the extended end of the boom. The shorter end of the boom includes a moveable counterweight 26 that is operable for raising the boom. The boom is then locked, the counterweight is moved, and the boom is released to swing freely. The movable counterweight includes first and second storage tanks 34 and 35, a counterweight fluid 36, and at least one pump 39 for moving the counterweight fluid between the first and second storage tanks. Passengers are loaded into the passenger carriage when the boom is in the down position. The boom is then raised by moving the counterweight fluid into the first storage tank. After the boom is raised, a brake is set to lock to boom in the raised position, and the counterweight fluid is moved into the second storage tank. The operator then lowers the boom by releasing the brake. The boom swings through approximately 270 degrees, and the passenger carriage may make a 360 degree loop at the end of the first swing.

32 Claims, 5 Drawing Sheets

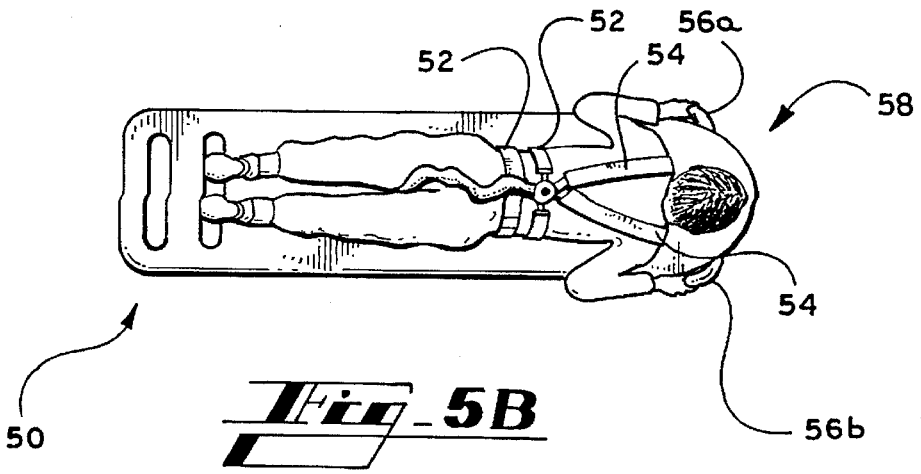
Fig_5B
Fig_7
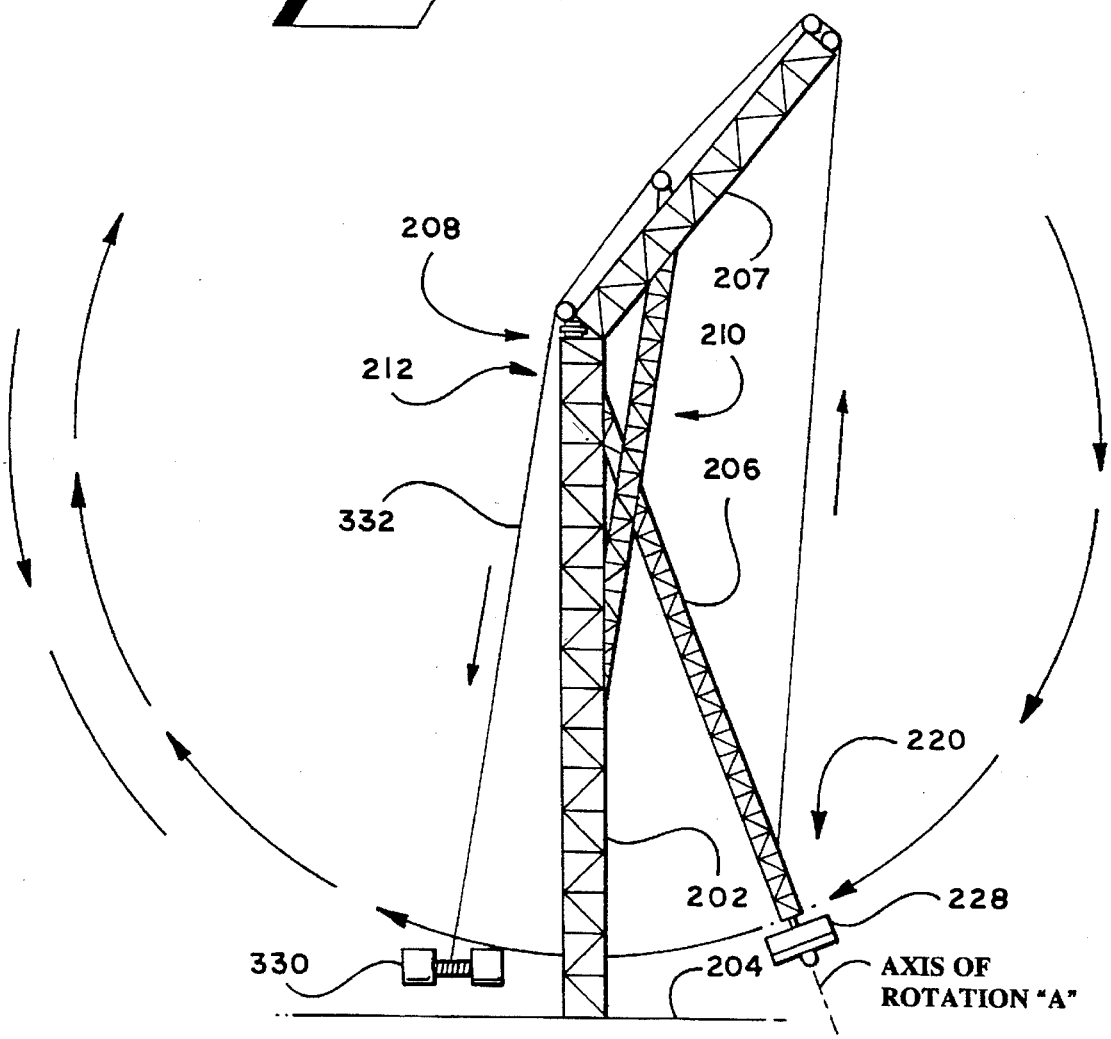

SWINGING BOOM AMUSEMENT RIDE

TECHNICAL FIELD

The present invention relates to amusement rides, and more particularly to an amusement ride including a tower and a passenger carrying boom pivotably attached to the tower in which the boom is raised to a nearly vertical position and then released.

BACKGROUND OF THE INVENTION

G. W. Ferris would no doubt be pleased and amazed to see the wide variety of amusement rides that have been developed since he invented his famous Wheel in 1893. Amusement parks have become popular attractions in major cities across the United States and abroad. Certain amusement rides that cater to adult thrill seekers have become increasingly exciting, ever striving to hurl passengers at faster speeds and with greater acceleration. In recent years, very fast roller coasters and very high free-fall amusement rides have found increasing popularity as adult high-speed attractions.

The increase in the popularity of high-speed adult amusement rides has been accompanied by a general increase in the popularity of adult thrill seeking activities. Bungee jumping, acrobatic ski jumping, wind surfing, sky diving, and other activities that involve a controlled free-fall have become immensely popular in the past decade or so. For example, the activity known as "sky surfing" is a relatively new thrill seeking activity in which a sky diver leaps from an airplane with a surf-like board attached to his or her feet. The board is used as an air foil which allows a skilled sky surfer to perform acrobatic feats while plummeting towards the Earth. Amusement park operators often find it advantageous to capitalize on the popularity of other popular thrill seeking activities by developing amusement rides that simulate the sensations experienced by partakers of such activities. As a result, amusement rides that allow riders to indulge in an actual or simulated free-fall experience have become very popular.

Of course, amusement rides must meet requirements that many other thrill seeking activities do not. In addition to the obvious safety concerns, an amusement park operator is critically concerned with the financial aspects of operating an amusement ride. In general, an amusement ride operator desires a ride that lots of people want to ride, and that can accommodate a fast mover of patrons. Thus, an amusement ride should not only be fun to ride, but should also be quick to complete, quick to reset, and so thrilling that patrons are willing to pay a substantial sum of money to experience the ride not only once, but over and over again. Much effort goes into developing new amusement rides that meet these often competing objectives.

Many other factors bear on the profitability of owning and operating an amusement ride. In general, it is preferable for an amusement ride to be easily transportable. It is therefore preferable for a ride to be easy to erect and disassemble into relatively light weight sections that are easy to pack into standard transportation containers. It is also advantageous for an amusement ride to be energy efficient, easy to load with passengers, easy to operate, and inexpensive to maintain. In addition, ground space and lighting are expensive to procure in an amusement park setting. Therefore, it is advantageous for a ride to occupy a minimum of ground space. Consequently, so-called "vertical real estate" amusement rides, i.e., rides that are deployed primarily in vertical configurations, are desirable from the operator's standpoint.

Moreover, many riders enjoy both the height and the free-fall sensation that accompany the typical vertical real estate amusement ride.

Bungee jumping is an example of vertical real estate amusement ride that gives a jumper a free-fall experience. Bungee jumping, however, is not a suitable activity for certain amusement park patrons such as small children and all but the most daring adults. Indeed, safe bungee jumping requires some skill, as jumpers have been known to occasionally fall at an angle with respect to the bungee cord such that the jumper is dangerously whipped when the cord becomes taut. There is therefore a need for an amusement ride that, like bungee jumping, gives the riders the sensation of a free-fall from a substantial height, but is suitable for a greater number of amusement park patrons than is bungee jumping.

Other free-fall amusement rides use cables to suspend a passenger carriage that is raised to substantial height and then released. The passenger carriage must be decelerated to a stop at the bottom of the descent, for example through deployment of a parachute aided by mechanical brakes. These rides fail to make maximum use of the potential energy embodied in the initial height of the passenger carriage because the carriage must be safely decelerated prior to reaching the bottom of the decent. It is generally expensive to construct and maintain braking devices for such free-fall rides. In addition, these rides often take a considerable time to reset, as the passenger carriage must be raised by reeling in the cables after each ride.

Another type of free-fall ride includes a passenger carriage that travels on an "L" or "U" shaped track that curves from a substantially vertical to a substantially horizontal configuration at the bottom of the decent. A passenger carriage is raised to the top of the track and then released. This type of ride maximizes the use of the potential energy embodied in the initial height of the passenger carriage, as the passenger carriage need not be decelerated prior to reaching the bottom to the descent. However, this type of ride also uses considerably more ground space than a truly vertical real estate amusement ride. It may also take a relatively long time to reset such a ride.

Swinging pendulum amusement rides have been in use for many years. These rides usually use a rotating tire to frictionally engage a free-swinging passenger carriage. The rotating tire gives the carriage a little push each time the carriage passes by the rotating tire, thereby urging the carriage into successively higher arcs. This type of pendulum ride is typically limited to a radial length of approximately forty feet or so, and may swing the passenger carriage through a complete 360 degree arc. However, the maximum height and resulting speed of the passenger carriage is such that the ride is somewhat less than thrilling for some riders. Indeed, such rides are typically counted among the rides in an amusement park considered appropriate for younger riders. Motion sickness caused by the repetitive motion of such a ride can also be a problem for some riders. Moreover, such a swinging pendulum amusement ride is relatively slow to complete because it takes many passes to intermittently urge the passenger carriage into its maximum arc.

A substantially more thrilling swing-type amusement ride is described in Kitchen et al., U.S. Pat. No. 5,267,906. A support tower and a somewhat shorter and separate launch tower are spaced a distance apart. A cable is attached near the top of the support tower at one end, and to a passenger at the other. A launch line is removably attached to the passenger at one end and near the top of the launch tower at the other. The passenger is raised to a height of thirty feet or more when the launch line is reeled in at the launch tower. The launch line is then detached from the rider who is released to swing freely. The angle to which the passenger may be raised is limited to ninety degrees because, beyond ninety degrees, the cable would develop slack as the passenger fell vertically when initially dropped. The height to which the passenger may be raised is therefore limited to the height of the support tower. The cable swing ride described by Kitchen et al. also suffers from the disadvantage of a long reset time as it is difficult to stop a passenger's swinging back and forth once released. It also requires a substantial amount of ground space, as the launch tower and the support tower must be spaced apart by a distance approaching the length of the cable.

A "jump-over" amusement ride is described in Harris, U.S. Pat. No. 3,885,788. A boom is divided by a pivot into an extended end and a shorter end. The shorter end of the boom includes a movable counterweight. A passenger carriage is pivotably attached to the extended end of the boom. The boom is attached at its pivot to an axle that is supported above the ground at a height slightly greater than the length of the shorter end of the boom. Passengers are loaded into the passenger carriage and the counterweight is adjusted to nearly balance the boom. The passengers may then "jump" to rotate the boom and thereby vault the passengers up, across, and down on the other side of the axle (i.e., jump-over). The passengers may then vault themselves back over the axle to the side on which they started. The amusement ride described by Harris is substantially less thrilling than a true free-fall ride because the boom must be nearly balanced by the counterweight so that the passengers can easily raise the boom, which must necessarily return slowly. The passenger carriage therefore travels slowly in such a ride.

There is therefore a need for an improved amusement ride that gives the riders the sensation of a free-fall from a substantial height, and that is suitable for a wide range of amusement park patrons.

There is also a need for an improved free-fall amusement ride that has relatively short completion and reset times.

There is also a need for an improved free-fall amusement ride that efficiently uses vertical real estate.

There is also a need for an improved free-fall amusement ride that is efficient and easy to operate and maintain.

There is also a need for an improved free-fall amusement ride that is easy to erect, disassemble, and transport.

SUMMARY OF THE INVENTION

The present invention meets the above-described needs by providing a free-swinging pendulum-type amusement ride, known presently under the name "AIR SURFER AMUSEMENT RIDE," in which a passenger carriage attached to a pivoting boom is raised to a substantial height and then released to swing freely through a substantial arc. In a preferred embodiment, which is described in detail herein, the passenger carriage may be raised to a height of approximately 150 feet, and the boom swings freely through an arc of approximately 270 degrees. One preferred embodiment is thus configured to provide a relatively high-speed, high-acceleration amusement ride suitable for adult riders. It is noted that a swinging boom amusement ride may be configured to be larger than the described preferred embodiment to provide a ride generating even greater speed and acceleration; or may be configured to be smaller than the described preferred embodiment to provide a ride generating less speed and acceleration. In particular, smaller rides may be provided for use by young patrons.

Generally described, a first preferred embodiment of the present invention includes (1) a tower extending above a support surface such as the ground, (2) an elongated boom including a pivot and an extended end, (3) a rotatable connection between the top end of the tower and the pivot of the boom, (4) a device operable for raising the extended end of the boom and then releasing it to swing freely, and (5) a passenger carriage that is pivotably attached to the extended end of the boom. The ride is configured such that the passenger carriage is supported above the support surface when the elongated end of the boom is disposed vertically downward. The boom may therefore swing freely about its pivot, causing the passenger carriage to swing under the pivot at great speed. A movable passenger loading deck is positioned under the passenger carriage to load passengers into the passenger carriage, and then moved out of the way to provide a suitable amount of clearance between the riders in the passenger carriage and the support surface.

According to another aspect of the first preferred embodiment of the present invention, a movable counterweight attached to a shorter end of the boom is operable for raising the extended end of the boom. When the counterweight is in a first position, the boom is gravitationally urged into a substantially vertical position with the extended end of the boom disposed upward; and when the counterweight is in a second position, the boom is gravitationally urged into a substantially vertical position with the extended end of the boom disposed downward. The movable counterweight includes first and second storage tanks, a counterweight fluid, and at least one pump for moving the counterweight fluid from the first storage tank to the second storage tank.

The inventive amusement ride is operated by starting with the extended end of the boom in a down position. Passengers are then loaded and secured in the passenger carriage. The counterweight is then placed in the first position, thus raising the extended end of the boom to a raised position. A brake or a separate boom lock is then set to lock the extended end of the boom in the raised position, and the counterweight is moved to the second position. It will be appreciated that at this point the inventive amusement ride is locked and loaded, i.e., the passengers are in the passenger carriage, the extended end of the boom is locked in the raised position, and the extended end of the boom is gravitationally urged in the downward direction. The operator of the amusement ride then lowers the boom by releasing the brake or boom lock, allowing gravity to cause the extended end of the boom to swing freely downward and under the pivot with great speed and acceleration. At the end of the swinging action, which may be brought to an end through the use of a brake that resists the rotation of the boom with respect to the tower, the extended end of the boom is once again in the down position.

Generally described, a second preferred embodiment of the present invention includes (1) a tower extending above a support surface such as the ground, (2) an elongated boom having a pivot dividing the boom into first and second ends that are approximately equal in length, (3) a rotatable connection between the top end of the tower and the pivot of the boom, (4) a device operable for selectably raising either end of the boom and then releasing it to swing freely, and (5) first and second passenger carriages pivotably attached to the first and second ends of the boom, respectively. The ride is configured such that each passenger carriage is supported above the support surface when the end of the boom to which it is attached is disposed vertically downward. The boom may therefore swing freely about its pivot, causing the passenger carriages to swing under the pivot at great speed. A movable passenger loading deck is positioned under each passenger carriage to load passengers into the passenger carriage, and then moved out of the way to provide a suitable amount of clearance between the riders in the passenger carriage and the support surface.

According to another aspect of the second preferred embodiment of the present invention, a movable counterweight attached to the boom that may be moved across the pivot of the boom is operable for raising either end of the boom. When the counterweight is in a first position, the first end of the boom is gravitationally urged into the down position and the second end of the boom is urged into the raised position; and when the counterweight is in a second position, the first end of the boom is gravitationally urged into the raised position and the second end of the boom is urged into the down position. The movable counterweight includes first and second storage tanks, a counterweight fluid, and at least one pump for moving the counterweight fluid from the first storage tank to the second storage tank.

The second preferred embodiment of the inventive amusement ride is operated by positioning the counterweight in the first position, causing the first end of the boom to be urged into the down position. Passengers are then loaded and secured in the first passenger carriage. A brake or a separate boom lock is then set to lock the boom, and the counterweight is moved to the second position. The boom is then released to swing freely. At the end of the swinging action, which may be brought to an end through the use of a brake that resists the rotation of the boom with respect to the tower, the second end of the boom is in the down position, and passengers are loaded into the second passenger carriage. The brake or a separate boom lock is again set to lock the boom, and the counterweight is moved back to the first position. The boom is again released to swing freely. The second preferred embodiment of the present invention thus approximately doubles the passenger carrying capability of the inventive amusement ride with respect to the first preferred embodiment.

According to another aspect of the present invention, two storage tanks and a counterweight fluid provide the device operable for raising the boom. This aspect of the present invention allows for quick ride completion and reset times, as the fluid can be moved quickly from one tank to the other. Moreover, the counterweight fluid, preferably water, can be removed from the ride prior to shipping, thus reducing the weight that must be shipped.

Generally described, a third preferred embodiment of the present invention includes (1) a tower extending above a support surface, (2) a lifting boom extending above the tower, (3) a swinging boom having a pivot and an extended end, (3) a rotatable connection between the top end of the tower and the pivot of the boom, (4) a passenger carriage attached to the extended end of the boom whereby the passenger carriage is supported above the support surface when the extended end of the boom is disposed vertically downward, and (5) a device operable for raising the extended end of the boom and then releasing it to swing freely. The passenger carriage is preferably pivotably attached to the extended end of the boom. The preferred device for raising the extended end of the boom and then releasing it to swing freely includes a winch that is operable for reeling in a cable. The cable is supported by the lifting tower and releasably connected to the swinging boom.

According to another aspect of the present invention, the boom is raised to a substantially vertical position before release. This aspect of the present invention allows the amusement ride to take advantage of the combined height of the tower and the extended end of the boom in imparting potential energy to the passenger carriage.

According to another aspect of the present invention, the boom swings through a substantial arc without decelerating prior to end of the descent. This aspect of the invention allows the riders to experience the excitement of a free-fall from the maximum height attained by the passenger carriage.

According to another aspect of the present invention, the amount of ground space required for the ride is minimized, thus minimizing cost to the ride operator for procuring.

According to another aspect of the present invention, the tower and boom may be disassembled into sections no larger than approximately nineteen feet in any dimension. This configuration allows the ride to be easily disassembled and packed into standard shipping containers used by rail, sea, and air carriers.

While a preferred embodiment of the present invention is disclosed in the context of a commercial-scale amusement ride, those skilled in the art will appreciate that the principles of the present invention may be applied to virtually any type of amusement ride that incorporates a free-swinging boom.

Therefore, it is an object of the present invention to provide an improved amusement ride that gives the riders the sensation of a free-fall from a substantial height, and that is suitable for a wide range of amusement park patrons.

It is a further object of the present invention to provide an improved free-fall amusement ride that efficiently uses vertical real estate.

It is a further object of the present invention to provide an improved free-fall amusement ride that is efficient and easy to operate and maintain.

It is a further object of the present invention to provide an improved free-fall amusement ride that is easy to erect, disassemble, and transport.

That the present invention and a preferred embodiment thereof improve over the drawbacks and accomplish the objects set forth above will become apparent from the following detailed description of a preferred embodiment.

BRIEF DESCRIPTION OF THE DRAWINGS

FIGS. 5A and 5B are similar top views of an illustrative board for carrying passengers on the inventive amusement ride, with FIG. 5A showing the board empty and FIG. 5B showing board with a passenger thereon.

FIG. 7 is a side view of a third preferred embodiment of the inventive amusement ride.

DETAILED DESCRIPTION OF THE PREFERRED EMBODIMENTS

Figure 1:
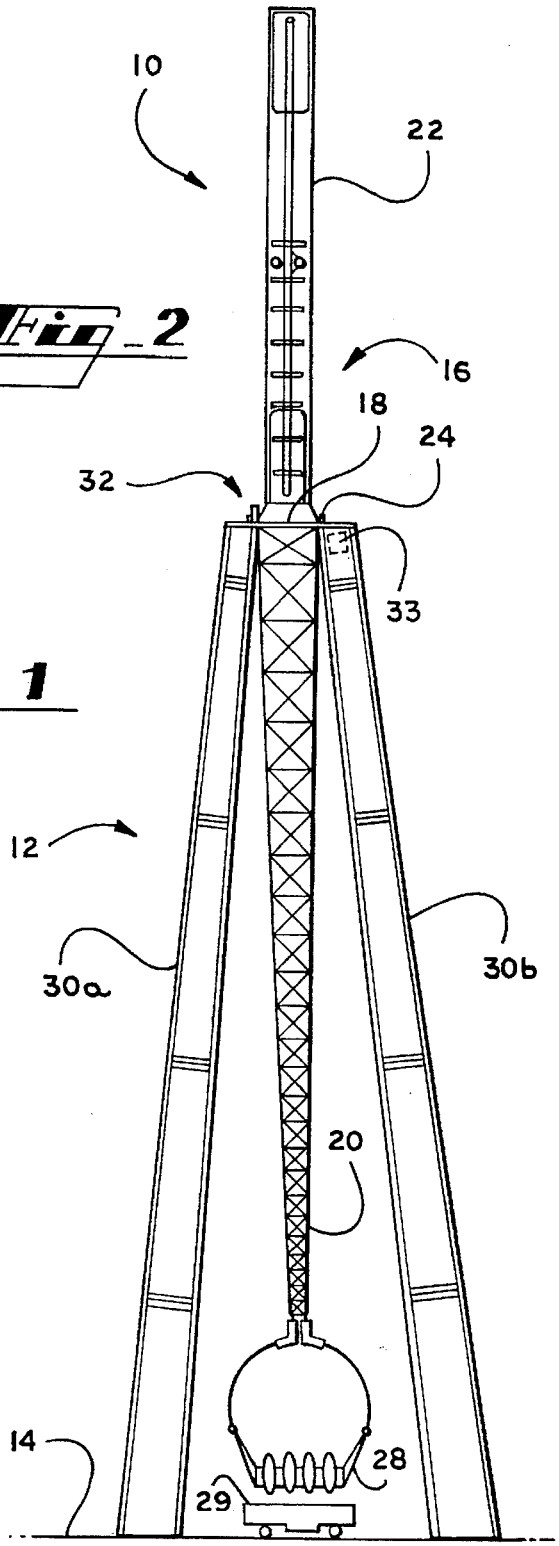
FIG. 1 is a side view of a first preferred embodiment of the inventive amusement ride with the extended end of the boom in the down position.

Referring to the drawings, in which like numerals indicate like elements throughout the several figures, FIG. 1 is a side view of a first preferred embodiment of the present invention, a swinging boom amusement ride. Generally, the first preferred embodiment of inventive amusement ride 10 includes a tower 12 extending above a support surface 14 such as the ground or a platform. The tower 12 supports an elongated boom 16 that includes a pivot 18, an extended end 20, and a shorter end 22. The tower 12 and the boom 16 are pivotably connected by way of a rotatable connection 24 between the top end of the tower 12 and the pivot 18 of the boom 16. A passenger carriage 28 is pivotably attached to the extended end 20 of the boom 16. The shorter end 22 of the boom 16 includes a moveable counterweight 26 that is operable for raising the extended end 20 of the boom 16. Once the extended end 20 of the boom 16 is raised, a brake 32 or a separate boom lock 33 is set to lock the boom in the raised position; and the counterweight 26 is moved. The brake or boom lock is then released, allowing the boom 16 to swing freely. As shown in FIG. 1, the amusement ride 10 is configured such that the passenger carriage 28 is supported above the support surface 14 when the extended end 20 of the boom 16 is in the down position. The boom 16 may therefore swing freely about its pivot 18 causing the passenger carriage 28 to swing under the pivot 18 at great speed. A movable passenger loading deck 29 is positioned under the passenger carriage 28 to load passengers into the passenger carriage, and then moved out of the way to provide a suitable amount of clearance between the riders in the passenger carriage and the support surface 14.

Figure 2:
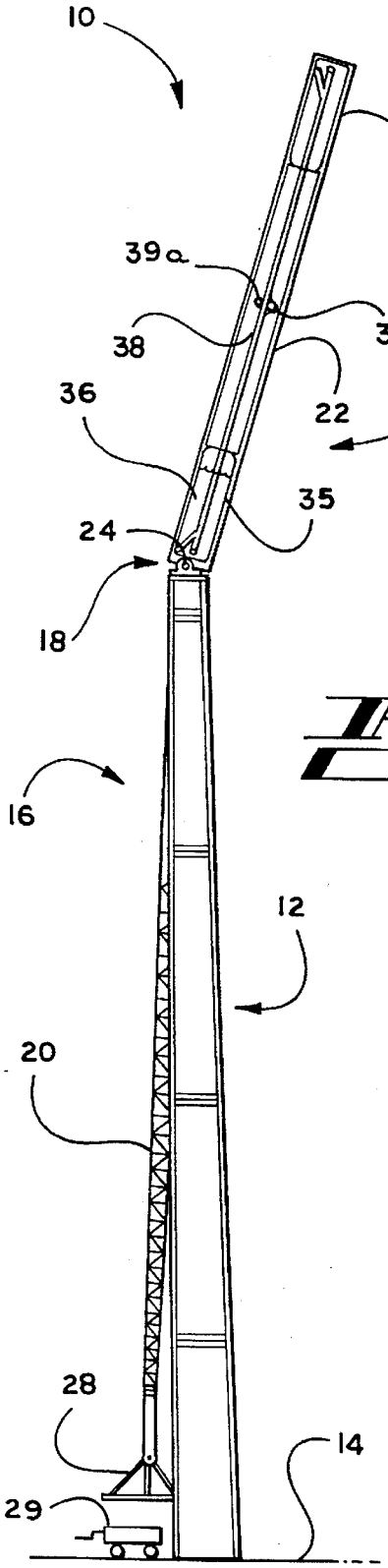
FIG. 2 is a front view of a first preferred embodiment of the inventive amusement ride with the extended end of the boom in the down position.

As shown in FIG. 2, the tower 12 includes two support legs 30*a* and 30*b* forming a basic inverted "V" shaped support structure. A brake 32 such as a conventional hydraulic disc or drum friction brake selectably resists rotation of the boom 16 with respect to the tower 12, thereby allowing the operator of the ride to control and stop swinging of the boom 16. The brake 32 is operable for securely locking the boom 16 with respect to the tower 12. The brake 32 may be abruptly released to allow the boom 16 to swing freely about its pivot 18. It will be appreciated that a separate boom lock 33 such as a cross-bar, ratchet and pawl, or other suitable device may be included, in addition to the brake 32, to securely lock the boom 16 with respect to the tower 12.

The height of the tower 12 may be varied to provide rides with differing cost and performance characteristics. Indeed, it is believed that smaller rides, such as those with towers in the 20 to 40 foot range, will be popular amusement rides for smaller children. The first preferred embodiment, which is intended to provide a high-speed, high-acceleration ride for adults, includes a tower that is approximately 80 feet tall. It will be appreciated that many surfaces may equivalently provide the support surface 14 such as the ground, a raised platform, or a traveling platform such as a movable deck or truck bed. It will also be appreciated that tower 12 may extend above the support surface 14 in any of a number of equivalent ways. For example, the tower 12 may include anchoring sections extending into the ground, or it may be affixed to anchors with bolts or pins, or it may be affixed in a suitable manner to a heavy structure such as a platform, deck, or truck.

The design of the tower 12 embodies a basic design trade-off. Generally, stronger support legs cost more to construct but reduce the amount of ground space required to accommodate the amusement ride. A less expensive support structure, such as a truss or guy wire supported structure, may be used at the expense of more ground space. The preferred configuration of the tower 12 is designed to minimize the amount of ground space required to accommodate the inventive amusement ride, and therefore relies on very strong support legs 30*a* and 30*b*. The preferred support legs may be constructed of A500 steel. It will be appreciated that many tower configurations would function equivalently in the present invention. For example, each support leg 30 could be configured as an "A" of "H" structure. Similarly, a truss or guy wires could be used to provide support for the tower.

Still referring to FIG. 2, the extended end 20 of the boom 16 is constructed of tapering lattice sections that narrow in the direction from the pivot 18 to the passenger carriage 28. It will be appreciated that the stress imparted on the boom 16 is greater nearer the pivot 18. The tapered configuration correspondingly provides a stronger structure nearer to the pivot 18. It will be appreciated that many boom configurations would function equivalently in the present invention such as a non-tapering lattice structure or a conventional "I-beam".

Referring once again to FIG. 1, the extended end 20 and the shorter end 22 of the boom 16 are configured to form an obtuse angle of approximately 168 degrees. The shorter end 22 of the boom 16 includes a movable counterweight 26 that includes first and second storage tanks 34 and 35 and a counterweight fluid 36 such as water. The first and second storage tanks are spaced radially apart within the shorter end 22 of the boom 16. The first storage tank 34 is preferably located at the radial extreme of the shorter end 22 of the boom 16, whereas the second tank 35 is preferably located adjacent the pivot 18 of the boom 16. A conduit 38 connects, and pumps 39*a* and 39*b* are operative for transporting the counterweight fluid between, the first and second storage tanks. When the counterweight fluid 36 is in the second storage tank 35, the extended end 20 of the boom 16 is gravitationally urged downward in a substantially vertical position as shown in FIG. 1.

Figure 3:
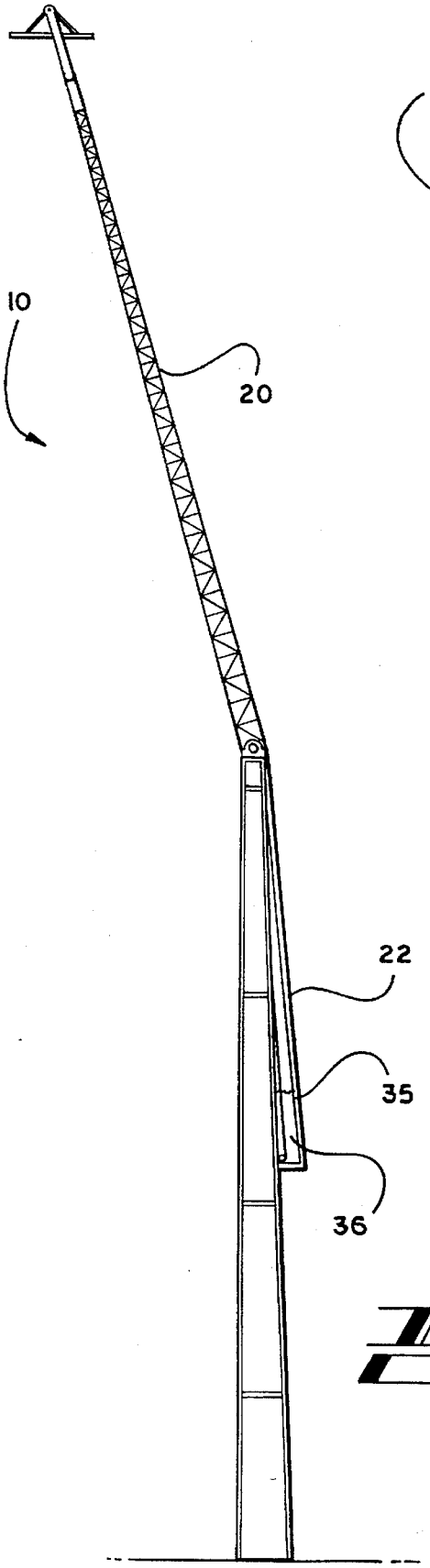
FIG. 3 is a side view of a first preferred embodiment of the inventive amusement ride with the extended end of the boom in the raised position.

To operate the first preferred embodiment of the inventive amusement ride, passengers are loaded into the passenger carriage 28 when the extended end 20 of the boom 16 is in the down position as shown in FIG. 1. It will be appreciated that the movable counterweight 26 could be adjusted to raise the boom 16 to any angle within its range of ascent. Passengers could therefore be equivalently loaded into the passenger carriage 28 when it boom is in another position, such as the raised position. Such a configuration would be advantageous if a raised loading platform was provided. Once passengers are loaded into the passenger carriage 28, the extended end 20 of the boom 16 is raised by positioning the counterweight fluid 36 in the first storage tank 34. FIG. 3 shows a side view of the inventive amusement ride 10 with the extended end 20 of the boom 16 in the raised position. It will be appreciated that the extended end 20 of the boom 16 may equivalently be raised to a somewhat lower or higher position than the position shown in FIG. 3. The brake 32 or a separate boom lock 33 is then set to lock the boom 16 in the raised position, and the counterweight fluid 36 is moved from the first storage tank 34 to the second storage tank 35. It will be appreciated that at this point the inventive amusement ride is locked and loaded, i.e., the passengers are in the passenger carriage 28, the extended end 20 of the boom 16 is locked in the raised position, and the counterweight 26 is positioned so as to gravitationally urge the extended end 20 of the boom 16 downward. With the ride 10 in this configuration, as shown in FIG. 3, the operator of the amusement ride then lowers the boom by releasing the brake 32 or boom lock 33, thus allowing gravity to cause the extended end 20 of the boom 16 to swing freely downward and under the pivot 18 with great speed and acceleration.

It will be appreciated that the angle between the extended end 20 and the shorter end 22 of the boom 16 may be varied without departing from the spirit of the present invention. For example, the shorter end 22 of the boom 16 could be replaced with a movable counterweight structure configured to form an "L" or "T" shape (i.e., perpendicular to the extended end 20 of the boom 16) without departing from the spirit of the present invention. It will also be appreciated that lifting means other than the movable counterweight 26 may equivalently be provided for raising the extended end 20 of the boom 16. For example, the lifting means may be a crane, a winch, a hydraulic actuator, a pneumatic actuator, a bell crank, a ball screw, a removable weight, a balloon filled with hot air or a buoyant gas, a gear assembly, an electric motor and gear assembly, etc. Similarly, a lifting device spaced a distance apart from the tower 12 such as a truck-mounted crane could equivalently provide the lifting means.

Figure 4:
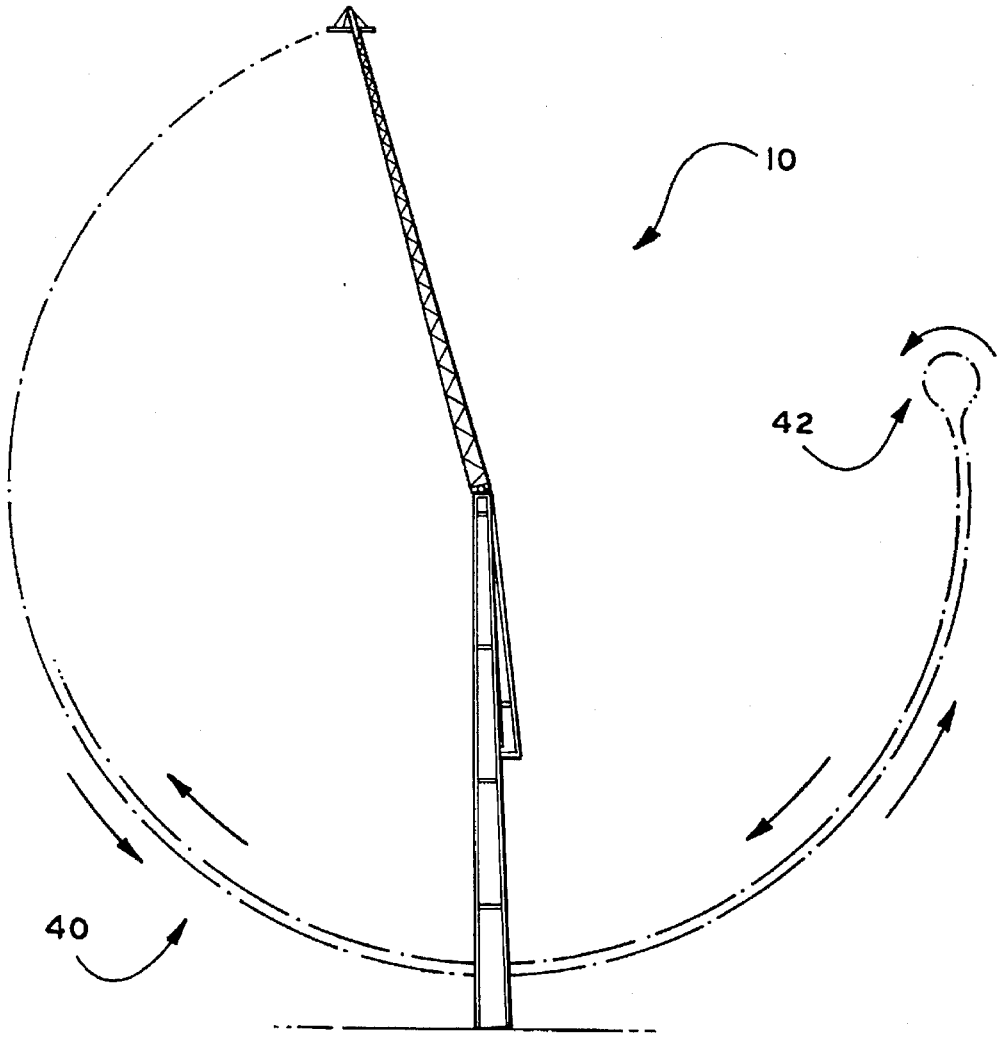
FIG. 4 is a side view of a first preferred embodiment of the inventive amusement ride illustrating the path traveled by riders thereon.

FIG. 4 is a side view of the first preferred embodiment of the inventive amusement ride 10 illustrating the path traveled by riders in the passenger carriage 28. In the preferred embodiment, the passenger carriage 28 is approximately 150 feet above the support surface 14 when the boom 16 is in the raised position, and the path traveled by the riders includes a first or major swing 40 of the boom 16 including approximately 270 degrees of rotation about the pivot 18, and a 360 degree loop 42 of the passenger carriage 28 about its pivotal connection with the extended end 20 of the boom 16. The loop 42 of the passenger carriage 28 occurs at the end of the major swing 40 of the boom 16. It is noted that the length of the major swing 40 may vary from ride to ride, and from cycle to cycle on the same ride, depending on the configuration of the ride and the way in which the passengers shift their weight in the course of a ride. The loop 42 may similarly vary, and may not occur on some rides or cycles.

It will be appreciated that the inventive amusement ride has short reset times because, at the end of the swinging of the boom 16, which may be brought to an end through the use of the brake 32, the extended end 20 of the boom 16 is once again in the down position. To provide for short ride completion times, it is generally preferred if the counterweight 26 can be moved quickly between its operable positions. The first and second storage tanks 34 and 35 each hold approximately 500 gallons. The pumps **39*a* and 39*b* can transport 1,000 gallons of water per minute. It will therefore be appreciated that an entire contents of a full storage tank 34 or 35 can be transported between the first and second storage tanks in approximately 30 seconds. The use of a counterweight fluid 36** allows the counterweight to be removed prior to shipping, thus reducing the weight that must be shipped when transporting the ride. It will be appreciated that many movable counterweight configurations would function equivalently in the present invention. For example, alternative configurations might include a winch and cables, a ball screw and rotator, or a hydraulic pump for moving a steel, lead, or fluid counterweight.

Figure 5A:
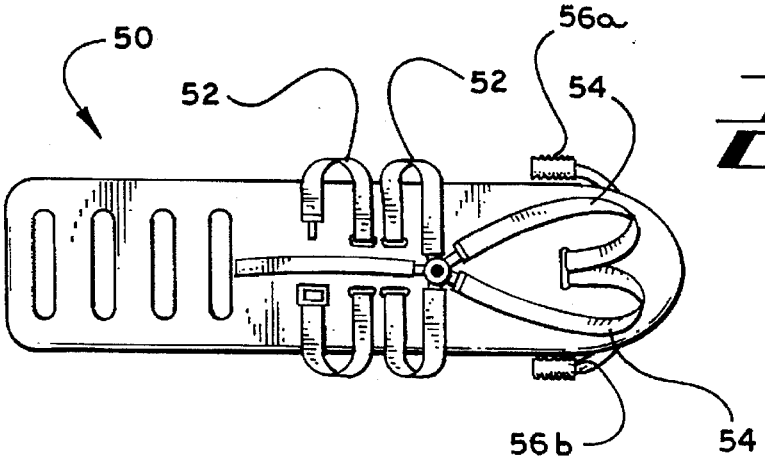

FIGS. 5A and 5B show top views of an illustrative board 50 for carrying passengers on the inventive amusement ride 10. The passenger carrier 28 is configured to carry a plurality of boards such as board 50, as shown in FIG. 2. The board 50 includes waist straps 52, shoulder straps 54, and handles **56*a* and 56*b* for securing a passenger 58. For example, a conventional five-point racing harness may provide suitable straps 52 and 54 for securing a passenger to the board 50. Preferred embodiments of the present invention may use surf-like boards as passenger carriers in keeping with the air surfing motif of the "AIR SURFER AMUSEMENT RIDE". It will be appreciated that many passenger carrying configurations would function equivalently in the present invention. For example, a passenger could ride standing or sitting on a board similar to board 50, sitting in a chair or on a bench, straddling a saddle, or hanging like the operator of a hang glider. Similarly, the passenger carriage 28** could be configured to carry a different number of passengers. Many other motifs could equivalently be provided for the ride such as ski jumping, motorcycle jumping, hang gliding, sky diving, etc.

Figure 6:
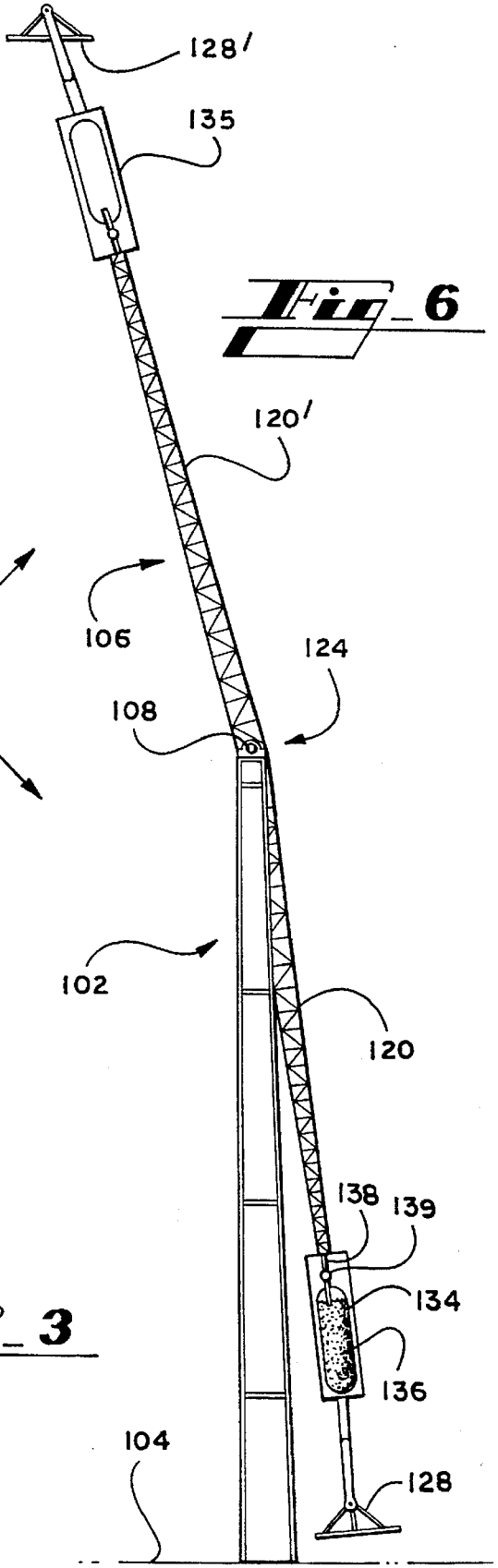
FIG. 6 is a side view of a second preferred embodiment of the inventive amusement ride.

FIG. 6 is a side view of a second preferred embodiment of the inventive amusement ride 10' that is similar to the above-described first preferred embodiment except as described below. Generally, the second preferred embodiment of the inventive amusement ride 10' includes a tower 102 extending above a support surface 104 such as the ground or a platform. The tower 102 supports an elongated boom 106 that includes a pivot 108 dividing the boom 106 into a first end 120 and a second end 120' that are approximately equal in length. The tower 102 and the boom 106 are pivotably connected by way of a rotatable connection 124 between the top end of the tower 102 and the pivot 108 of the boom 106. First and second passenger carriages 128 and 128' are pivotably attached to the first and second ends 120 and 120' of the boom 106, respectively. The boom 106 includes a moveable counterweight 126 that may be moved across the pivot 108 to selectably raise either end of the boom 106. When the counterweight is in a first position, the first end 120 of the boom 106 is gravitationally urged into the down position and the second end 120' of the boom is urged into the raised position; and when the counterweight 126' is in a second position, the first end 120 of the boom 106 is gravitationally urged into the raised position and the second end 120' of the boom is urged into the down position. In the second preferred embodiment, the movable counterweight 126 includes a first storage tank 134 and a second storage tank 135, a counterweight fluid 136, a conduit 138 connecting the first and second storage tanks, and at least one pump 139 for moving the counterweight fluid from the first storage tank to the second storage tank. It will be appreciated that modifications such as changes in the type of lifting device, the type of counterweight, or the configuration or location of the storage tanks and pumps shown in FIG. 6 are within the scope of the second preferred embodiment of the inventive amusement ride.

The second preferred embodiment of the inventive amusement ride is operated by positioning the counterweight fluid 136 in the first storage tank 134, causing the first end 120 of the boom 106 to be urged into the down position. Passengers are then loaded and secured in the first passenger carriage 128. A brake 32 or a separate boom lock 33 is then set to lock the boom, and the counterweight fluid is moved to the second storage tank 135. The boom 106 is then released to swing freely. At the end of the swinging action, which may be brought to an end through the use of the brake, the second end 120' of the boom is in the down position, and passengers are loaded into the second passenger carriage 128'. The brake or boom lock is again set to lock the boom, and the counterweight fluid 136 is moved back to the first storage tank 134. The boom 106 is again released to swing freely. The second preferred embodiment of the present invention thus approximately doubles the passenger carrying capability of the inventive amusement ride with respect to the first preferred embodiment.

FIG. 7 is a side view of a third preferred embodiment of the inventive amusement ride 10" that is similar to the above-described first and second preferred embodiments except as described below. Generally, the third preferred embodiment of the inventive amusement ride includes a tower 202 extending above a support surface 204 such as the ground or a platform. The tower 202 supports a swinging boom 206. The tower 202 also supports a lifting boom 207 that extends above the tower 202. The swinging boom 206 includes a proximal end 210 having a pivot 208. The tower 202 and the swinging boom 206 are pivotably connected by way of a rotatable connection 212 between the top end of the tower 202 and the pivot 208 of the boom 206. A rotatable connection 230 connects the passenger carriage 228 to the extended end 220 of the swinging boom 206. The preferred device for raising the extended end 220 of the swinging boom 206 and then releasing it to swing freely includes a winch 330 that is operable for reeling in a cable 332. The cable 332 is supported by the lifting tower 207 and releasably connected to the swinging boom 206. It will be appreciated that the lifting boom 207 could equivalently be a separate free-standing structure spaced apart from the tower 202. For example, a truck-mounted crane could equivalently provide the lifting boom 207.

The third preferred embodiment of the inventive amusement ride is operated by loading passengers into the passenger carriage 228 with the swinging boom 206 in the down position. The cable 332 is then attached to the swinging boom 206 and reeled in by the winch 330, thus raising the extended end 220 of the swinging boom 206. The extended end of the boom is then released to swing freely. It will be appreciated that an eye and hook connection between the cable 332 and the extended end 220 of the swinging boom 206 can be configured to automatically release the extended end of the boom when the extended end of the boom reaches a desired angle with respect to the cable 332.

Figures 8A, 8B:
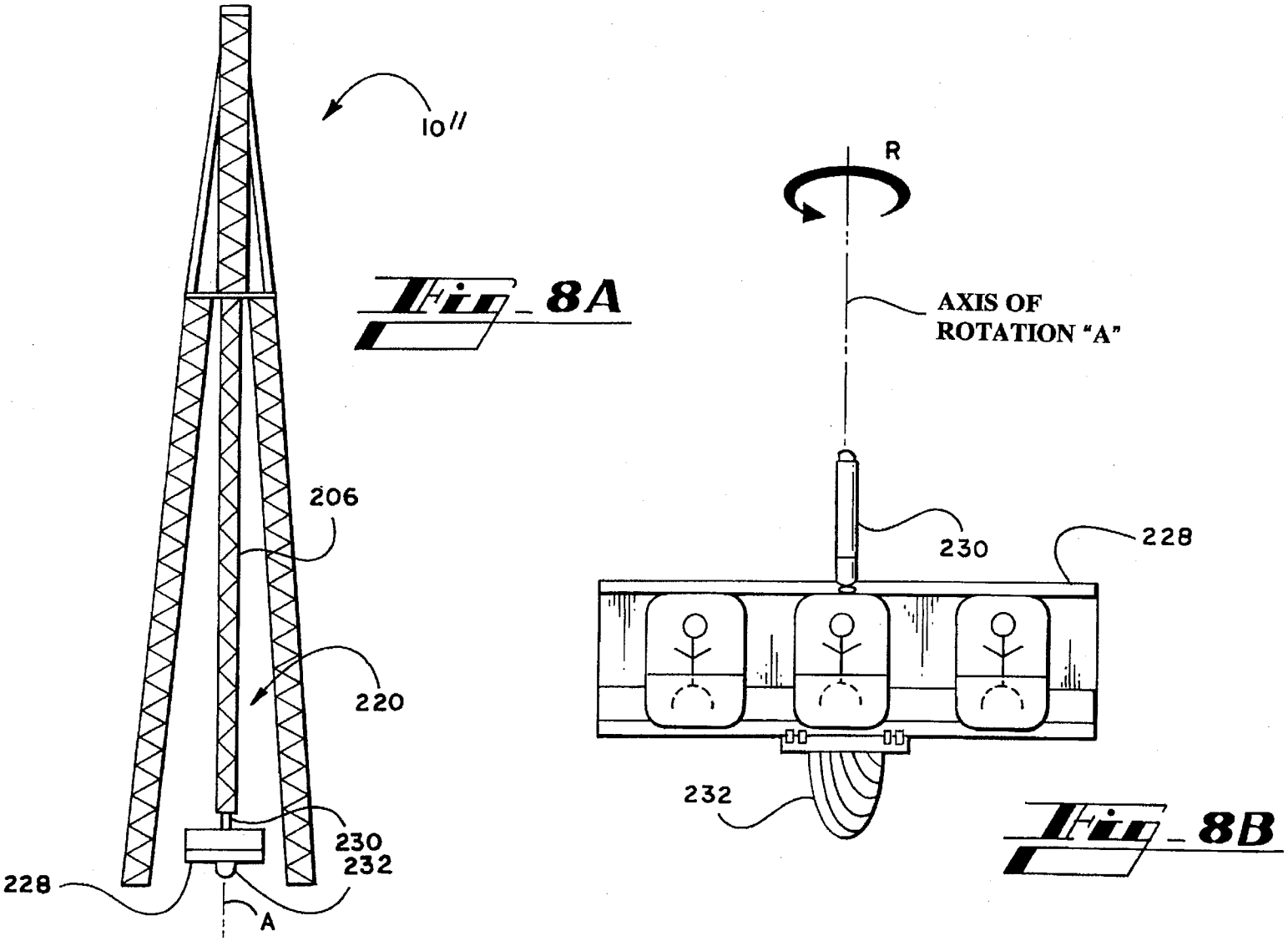
FIG. 8A shows a front view of the third preferred embodiment of the present invention.
FIG. 8B shows is a front view of a passenger carriage greater detail.

FIG. 8A shows a front view of the third preferred embodiment of the present invention 10" including the passenger carriage 228 and the rotatable connection 230 between the extended end 220 of the swinging boom 206. FIG. 8B shows the passenger carriage 228 in greater detail. The passenger carriage includes an air foil 232 disposed at an angle that causes the passenger carriage 228 to rotate about the rotatable connection 230 as the passenger carriage moves through the air. More specifically, the action of the air foil causes the passenger carriage 228 to rotate as indicated by "R" about "the axis of rotation A" as shown in FIG. 8.

In view of the preceding description, it is clear that the preferred embodiments of the swinging boom amusement ride are configured to provide high-speed, high-acceleration amusement rides that will provide great thrills and excitement for passengers. The inventive ride minimizes the use of ground space within an amusement park, has quick ride cycles and reset times, and is easy to load and unload with passengers. The inventive amusement ride contains few moving parts and is therefore easy and inexpensive to operate and maintain. Moreover, the inventive amusement ride is easy to assemble, to disassemble, and to pack for shipping. Water is used as a counterweight which may be emptied prior to shipping.

It should be understood that the foregoing relates only to the preferred embodiments of the present invention, and that numerous changes may be made therein without departing from the spirit and scope of the invention as defined by the following claims.

What is claimed is:

1. An amusement ride comprising:

a tower extending above a support surface;

an elongated boom having a pivot and an extended end;

a rotatable connection between the top end of said tower and said pivot of said boom;

a passenger carriage attached to said extended end of said boom, said passenger carriage being supported above said support surface when said extended end of said boom is disposed vertically downward;

lifting means for raising said extended end of said boom to a raised position through a non-oscillatory path comprising an arc of at least about 90 degrees; and means for releasing said extended end of said boom from said raised position to swing under said pivot and through an arc of at least about 180 degrees.

2. The amusement ride of claim 1, wherein said passenger carriage is pivotably attached to said extended end of said boom.

3. The amusement ride of claim 1, further comprising locking means for selectably preventing rotation of said boom with respect to said tower.

4. The amusement ride of claim 3, further comprising braking means for selectably resisting rotation of said boom with respect to said tower.

5. The amusement ride of claim 1, wherein said boom and said tower are demountably assembled from sections not larger than approximately nineteen feet in any dimension.

6. The amusement ride of claim 1, wherein the elongated boom comprises a shorter end opposite said pivot from said extended end, and, further comprising;

a movable counterweight attached to said shorter end of said boom.

7. The amusement ride of claim 6, wherein the movable counterweight comprises first and second storage tanks, a counterweight fluid, and means for moving said counterweight fluid from said first storage tank to said second storage tank.

8. The amusement ride of claim 7, wherein said second storage tank is positioned closer to said pivot of said boom than is said first storage tank.

9. The amusement ride of claim 1, wherein said lifting means comprises:

a winch; and a cable connected to said winch, said cable being releasably connected to said swinging boom, said cable being supported by said lifting tower.

10. The amusement ride of claim 1, wherein:

said passenger carriage is pivotably attached to said extended end of said boom so as to rotate about an axis extending from said pivot through said passenger carriage.

11. The amusement ride of claim 1, wherein:

said passenger carriage is pivotably attached to said extended end of said boom so as to rotate about an axis substantially transverse to an axis extending from said pivot through said passenger carriage.

12. The amusement ride of claim 1, wherein, the lifting means is operable for raising the extended end of the to a substantially vertical position; and the releasing means is operable for releasing the boom to swing through an arc of at least about 270 degrees.

13. An amusement ride comprising:

a tower extending above a support surface;

an elongated boom having a pivot and an extended end;

a rotatable connection between the top end of said tower and said pivot of said boom;

a passenger carriage attached to said extended end of said boom, said passenger carriage being supported above said support surface when said extended end of said boom is disposed vertically downward;

lifting means comprising a movable counterweight attached to said boom for raising said extended end of said boom; and means for releasing said extended end of said boom from a raised position.

14. The amusement ride of claim 13, wherein said movable counterweight comprises first and second storage tanks, a counterweight fluid, and means for moving said counterweight fluid between said storage tanks.

15. The amusement ride of claim 14, wherein said second storage tank is positioned closer to said pivot of said boom than is said first storage tank.

16. A method of operating an amusement ride comprising the steps of:

providing a tower extending above a support surface;

providing an elongated boom having a pivot and an extended end;

providing a rotatable connection between the top end of said tower and said pivot of said boom;

providing a passenger carriage attached to said extended end of said boom, said passenger carriage being supported above said support surface when said elongated end of said boom is disposed vertically downward;

raising said extended end of said boom to a raised position through a non-oscillatory path comprising an arc of at least about 90 degrees; and then releasing said boom from said raised position to swing under said pivot and through an arc of at least about 180 degrees.

17. The method of claim 16, wherein said step of providing a passenger carriage attached to said extended end of said boom comprises providing a passenger carriage that is pivotably attached to said extended end of said boom.

18. The method of claim 16, wherein the step of raising said extended end of said boom comprises the steps of:

providing a movable counterweight affixed to said boom;

positioning said counterweight in a first position whereby said extended end of said boom is gravitationally urged into a raised position; then locking said boom; then moving said counterweight to a second position whereby said extended end of said boom is gravitationally urged downward.

19. The method of claim 18, wherein said step of moving said counterweight to a second position comprises moving said counter weight closer to said pivot.

20. The method of claim 19, wherein:

said step of providing a movable counterweight comprises providing first and second storage tanks, a counterweight fluid, and means for moving said counterweight fluid from said first storage tank to said second storage tank;

said step of positioning said counterweight in a first position comprises moving said counterweight fluid from said second storage tank to said first storage tank; and said step of moving said counterweight to a second position comprises moving said counterweight fluid from said first storage tank to said second storage tank.

21. The method of claim 19, wherein:

said step of providing a movable counterweight comprises providing first and second storage tanks wherein said second storage tank is positioned closer to said pivot of said boom than is said fist storage tank, a counterweight fluid, and means for moving said counterweight fluid from said first storage tank to said second storage tank;

said step of positioning said counterweight in a first position comprises moving said counterweight fluid from said second storage tank to said first storage tank; and said step of moving said counterweight to a second position comprises moving said counterweight fluid from said first storage tank to said second storage tank.

22. The method of claim 16, wherein said step of providing a passenger carriage attached to said extended end of said boom comprises providing a passenger carriage that is pivotably attached to said extended end of said boom.

23. The method ride of claim 16, wherein, the step of raising the extended end of the boom comprises raising the extended end of the boom to a substantially vertical position; and the step of releasing the boom comprises releasing the boom to swing through an arc of at least about 270 degrees.

24. A method of operating an amusement ride comprising the steps of:

providing a tower extending above a support surface;

providing an elongated boom having a pivot and an extended end;

providing a rotatable connection between the top end of said tower and said pivot of said boom;

providing a passenger carriage attached to said extended end of said boom, said passenger carriage being supported above said support surface when said elongated end of said boom is disposed vertically downward;

raising said extended end of said boom by rotating said boom about said pivot to a substantially vertical position disposed upward; and then releasing said boom to swing freely about said pivot.

25. The method of claim 24, wherein said step of raising said extended end of said boom comprises the steps of:

providing a movable counterweight affixed to said boom;

positioning said counterweight in a first position whereby said extended end of said boom is gravitationally urged into a raised position.

26. The method of claim 24, after said step of positioning said counterweight in a first position, further comprising the steps of:

locking said boom; and then moving said counterweight to a second position whereby said extended end of said boom is gravitationally urged downward.

27. The method of claim 26, wherein:

said step of providing a movable counterweight comprises providing first and second storage tanks, a counterweight fluid, and means for moving said counterweight fluid from said first storage tank to said second storage tank;

said step of positioning said counterweight in a first position comprises moving said counterweight fluid from said second storage tank to said first storage tank; and said step of moving said counterweight to a second position comprises moving said counterweight fluid from said first storage tank to said second storage tank.

28. The method of claim 26, wherein:

said step of providing a movable counterweight comprises providing first and second storage tanks wherein said second storage tank is positioned closer to said pivot of said boom than is said first storage tank, a counterweight fluid, and means for moving said counterweight fluid from said first storage tank to said second storage tank;

said step of positioning said counterweight in a first position comprises moving said counterweight fluid from said second storage tank to said first storage tank; and said step of moving said counterweight to a second position comprises moving said counterweight fluid from said first storage tank to said second storage tank.

29. An amusement ride comprising:

a tower extending above a support surface;

an elongated boom having a pivot dividing said boom into first and second ends;

a rotatable connection between the top end of said tower and said pivot of said boom;

a first passenger carriage attached to said first end of said boom, said first passenger carriage being supported above said support surface when said first end of said boom is disposed vertically downward;

a second passenger carriage attached to said second end of said boom, said second passenger carriage being supported above said support surface when said second end of said boom is disposed vertically downward; and lifting means for selectably raising said first or second end of said boom to a raised position through a non-oscillatory path comprising an arc of at least about 90 degrees; and means for releasing said first or second end of said boom from said raised position to swing under said pivot and through an arc of at least about 180 degrees.

30. The amusement ride of claim 29, wherein said first and second passenger carriages are pivotably attached to said first and second ends of said boom, respectively.

31. An amusement ride comprising:

a tower extending above a support surface;

an elongated boom having a pivot dividing said boom into first and second ends;

a rotatable connection between the top end of said tower and said pivot of said boom;

a first passenger carriage attached to said first end of said boom, said first passenger carriage being supported above said support surface when said first end of said boom is disposed vertically downward;

a second passenger carriage attached to said second end of said boom, said second passenger carriage being supported above said support surface when said second end of said boom is disposed vertically downward; and lifting means comprising a movable counterweight attached to said boom for selectably raising said first or second end of said boom.

32. The amusement ride of claim 31, wherein said movable counterweight comprises first and second storage tanks, a counterweight fluid, and means for moving said counterweight fluid between said first and second storage tanks.

* * * * *